US006698156B2

(12) United States Patent
Quarrels et al.

(10) Patent No.: US 6,698,156 B2
(45) Date of Patent: Mar. 2, 2004

(54) METHOD AND APPARATUS FOR HOLLOW METAL FABRICATION

(75) Inventors: Wayne Quarrels, Demorest, GA (US); James Byrnes, Lula, GA (US)

(73) Assignee: Habersham Metal Products Company, Cornelia, GA (US)

( * ) Notice: Subject to any disclaimer, the term of this patent is extended or adjusted under 35 U.S.C. 154(b) by 103 days.

(21) Appl. No.: 09/825,123

(22) Filed: Apr. 3, 2001

(65) Prior Publication Data

US 2002/0139065 A1 Oct. 3, 2002

(Under 37 CFR 1.47)

(51) Int. Cl.[7] ..... E04B 1/00

(52) U.S. Cl. ..... 52/742.16; 249/39; 249/176; 52/264.1; 52/216; 52/656.2; 52/656.4; 52/742.14; 52/745.16

(58) Field of Search ..... 52/DIG. 1, 264.1, 52/216, 656.2, 656.4, 742.14, 742.16, 745.16; 249/39, 176

(56) References Cited

U.S. PATENT DOCUMENTS 5,174,910 A * 12/1992 Pita ..... 249/112
5,253,839 A * 10/1993 McClure ..... 248/354.1
5,437,431 A * 8/1995 Pita ..... 249/112

* cited by examiner

*Primary Examiner*—Carl D. Friedman
*Assistant Examiner*—Steve Varner
(74) *Attorney, Agent, or Firm*—Hinkle & O'Bradovich, LLC

(57) ABSTRACT

A method and apparatus for constructing hollow metal frames having a grout filled interior is disclosed. An apparatus includes a substantially planar body having an upper and lower surface. The upper surface includes at least one grip. The lower surface includes a gasket and a number of protrusions. The protrusions are placed into holes on the hollow metal frame into which additional components such as hinges are to be added. Grout is added to the frame and allowed to harden. Once the grout is hardened, the grout guard is removed and air spaces are retained. Screws and other components are typically filled into the air spaces.

13 Claims, 7 Drawing Sheets

410
415
415
425
420
415
405
415
400
425
430

METHOD AND APPARATUS FOR HOLLOW METAL FABRICATION

BACKGROUND OF THE INVENTION

I. Field of the Invention

The present invention relates generally to the field of hollow metal fabrication, and more particularly to a method and apparatus for adding grout to hollow metal.

II. Description of the Related Art

Hollow metal manufacturing typically includes the construction of hollow metal components such as doors, door frames, window frames and the like. Hollow metal products are used commercially for sturdy structures such as office buildings. Commonly, hollow metal products are also used in the construction of prisons and other detention facilities where sturdy frames and doors are important for security. In addition to frames and doors, pre-fabricated prison cells are also constructed.

Typically, when a frame is built into a prison or detention facility structure, the hollow metal frame has a hole cut near the top of the frame and grout or cement is poured into the frame to provide further sturdiness to the structure. However, when the grout is added to the frame, the construction on the frame is typically not complete. Hinges, strikes, locks NAME OTHER COMPONENTS and other components have not yet been added to the frame. The frame typically includes screw holes and other apertures for receiving these components.

Grout guards are commonly added to the inside of the frame in order to maintain an airspace so that when the components are screwed onto the frame, there is no resistance from hardened grout. FIG. 1A illustrates a prior art grout guard 100 that is representative of the type of grout guard presently used. The grout guard 100 is affixed in the interior of a hollow metal door frame 105. Typically a hinge reinforcement 110 is placed between the grout guard 100 and frame 105 in order to provide further support for the door hinge (not shown). Having the grout guard 100 affixed to the frame 105, grout is prevented from entering the air space in which screws enter when the hinge is attached. FIG. 1B illustrates another example of a hollow metal frame 120 having a prior art grout guard 125. The grout guard 125 is shown affixed to the frame 120. An air space is maintained to prevent grout from entering the are in which a strike plate (not shown) is affixed to the frame 120.

Often, the addition of these grout guards adds significant labor to the manufacture of hollow metal frames. The metal boxes also typically increase the material cost of the frame.

SUMMARY OF THE INVENTION

In accordance with the present invention and the contemplated problems which have and continue to exist in this field, the invention features a method and apparatus for maintaining the necessary air space for components in hollow metal frames while reducing the material cost of the frame and the labor associated with manufacturing the frame.

In general, in one aspect, the invention features an apparatus including substantially planar body having an upper surface and a lower surface, at least one grip connected to the upper surface and a plurality of air space retainers connected to and substantially perpendicular to the lower surface.

In an implementation, the apparatus also includes a substantially planar gasket having a first and second surface, wherein the first surface is in contact with the lower surface of the planar body, and wherein the air space retainers protrude from the second surface of the gasket.

In another implementation, the air space retainers is a substantially cylindrical rod having a first radius.

In another implementation, each cylindrical rod includes a gasket ring wrapped along the circumference of the rods, each ring having an outer radius larger than the first radius, wherein the ring is located at a point along the rod at a length measured from the lower surface of the body.

In another implementation, the cylindrical rod has a third radius located at a point along the rod where the rod intersects the body, wherein the third radius is greater than the first radius.

In another aspect, the invention features a grout guard including a substantially planar body having an upper surface and a lower surface at least one grip connected to the upper surface, a gasket connected to the lower surface and a plurality of cylindrical protrusions connected to and substantially perpendicular to the lower surface and to the gasket the protrusions each having a circular ring gasket around the circumference of the protrusions.

In yet another aspect, the invention features a grout guard kit including a hollow metal frame, a grout guard adapted to be attached and removed from the hollow metal frame and grout adapted to be added to the interior of the hollow metal frame.

In an implementation, the grout guard includes a substantially planar body having an upper surface and a lower surface, at least one grip connected to the upper surface, a gasket connected to the lower surface and a plurality of cylindrical protrusions connected to and substantially perpendicular to the lower surface and to the gasket.

In still another aspect, the invention features a method of manufacturing including forming a hollow metal frame, connecting one or more grout guards to one or more areas of the frame where components are to be added, adding grout to the interior of the frame and removing the grout guards after the grout hardens.

In an implementation, the grout guard is used only one time and disposed.

In another aspect, the invention features a method of installing a hollow metal frame including placing a hollow metal frame, attaching one or more grout guards to areas of the frame where components are to be added, adding grout to the interior of the frame, removing the grout guard when the grout hardens and adding the components to the frame.

One advantage of the apparatus is that the materials used in the manufacture of the apparatus and the material used to install the apparatus is less expensive than prior art grout guards.

Another advantage is that minimal necessary air spaces are maintained in the appropriate areas of hollow metal frames without the interference of larger bulkier grout guards.

Another advantage is that once the grout has hardened, the grout guard can be permanently removed from the frame and disposed.

Another advantage of the invention is that the air spaces created by the grout guard create a further aperture for screws to enter, providing further support for the threads of the screws.

Other objects, advantages and capabilities of the invention will become apparent from the following description taken in conjunction with the accompanying drawings showing the preferred embodiment of the invention.

DETAILED DESCRIPTION OF THE INVENTION

Figure 1A:
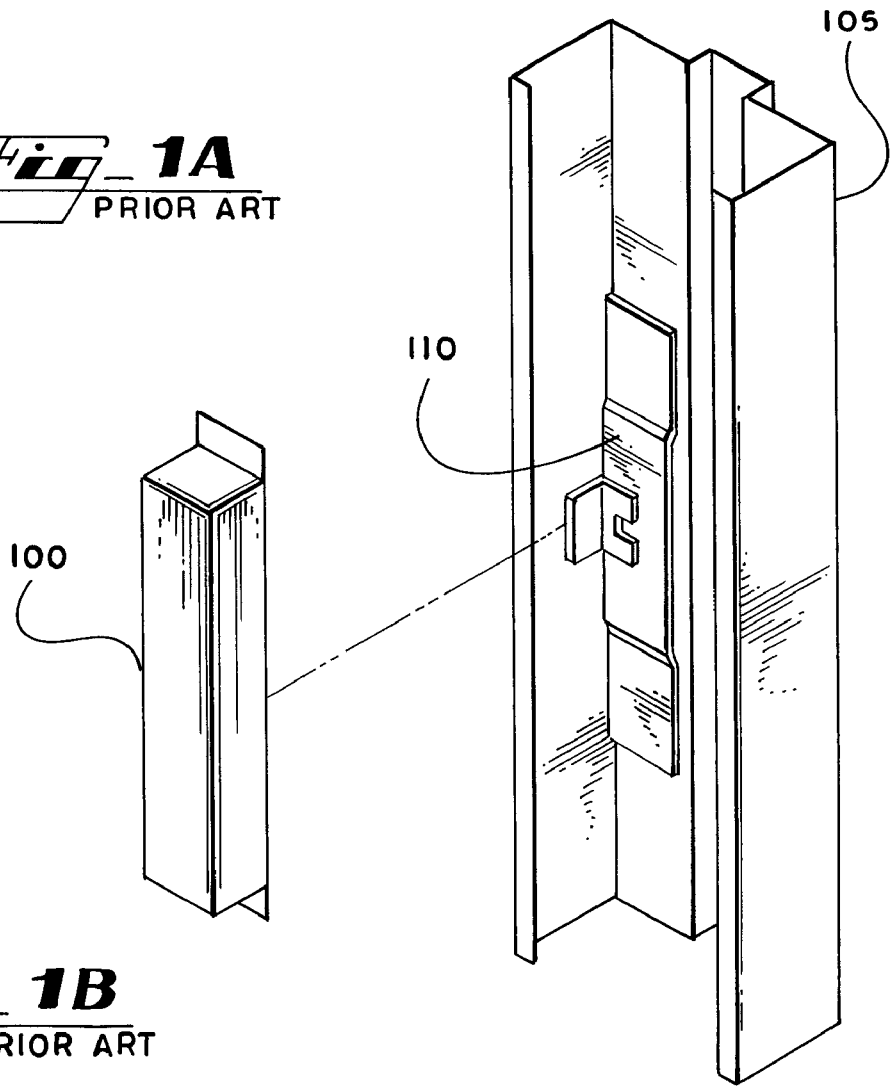
Fig 1A PRIOR ART
FIG. 1A illustrates a hollow metal frame having a prior art grout guard.
Figure 1B:
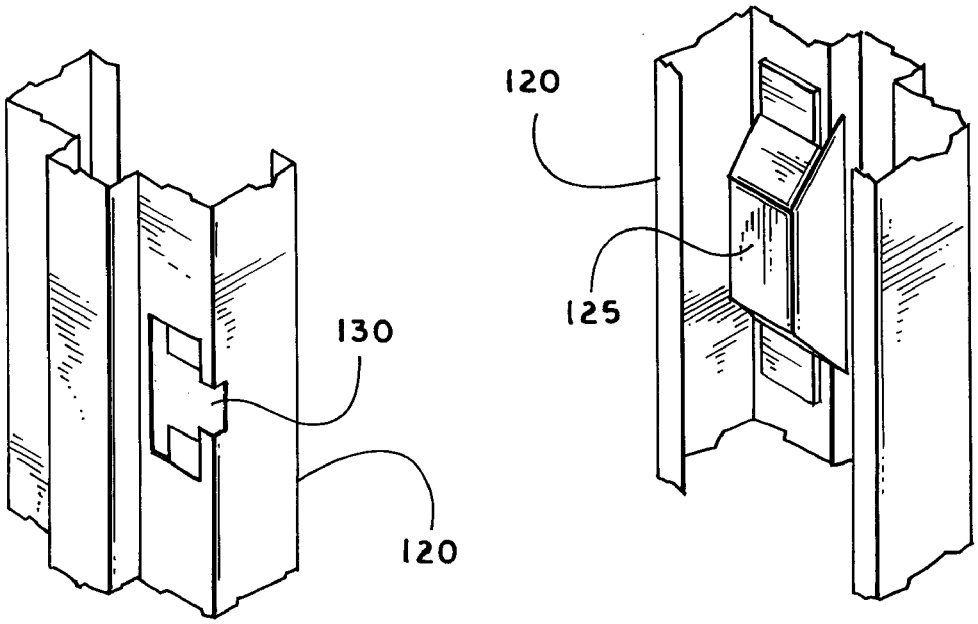
Fig 1B PRIOR ART
FIG. 1B illustrates a hollow metal frame having a prior art grout guard.
Figures 2A, 2B, 3:
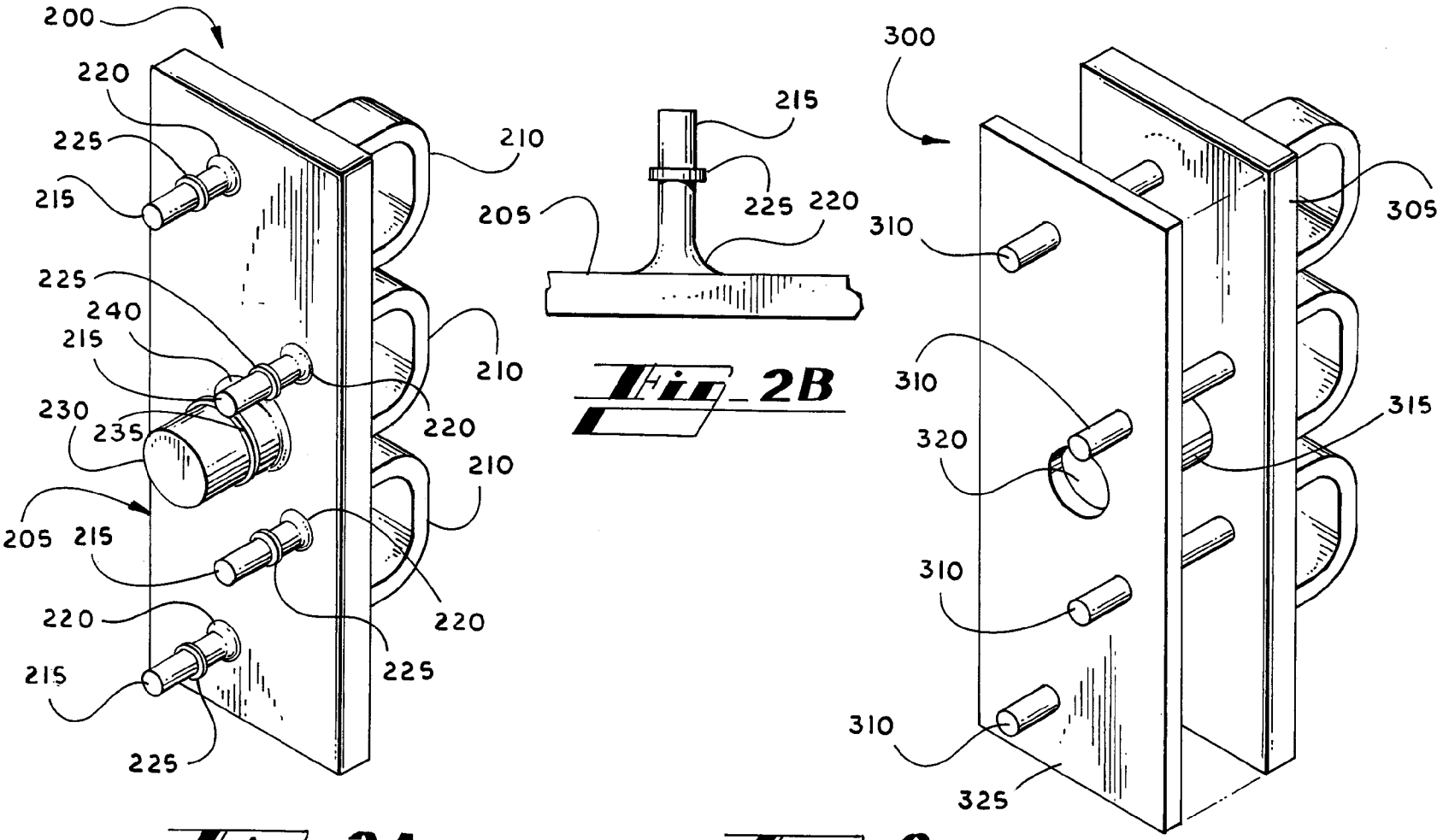
FIG. 2A illustrates a perspective view of an embodiment of a grout guard.
FIG. 2B illustrates a side view of an air space retainer.
FIG. 3 illustrates a grout guard having a gasket.

Referring to the drawings wherein like reference numerals designate corresponding parts throughout the several figures, reference is made first to FIG. 2A illustrates an embodiment of a grout guard 200. The grout guard includes a substantially planar body 205 that is typically in the shape of a rectangle. Other geometric shapes of the body 205 can be chosen. The rectangular shape is chosen in this embodiment because is fits smoothly along the surface and edges of a door frame (not shown).

The grout guard 200 also includes a one or more grips 210 connected to one side of the body 205. Typically the person who removes the grout guard 200 from the door frame can get a hold of the grout guard 200 by placing his fingers through the grips 210. The user can then apply an outward force to remove the grout guard. In an implementation, the user places his ring middle and ring fingers through the grips 210 to remove the grout guard. It is understood that there are many other ways to remove the grout guard from the frame. In this embodiment, three grips 210 are chosen because the use of three fingers to remove the grout guard 200 has been determined to provide the best leverage for removing the grout guard 200.

The grout guard also includes several air space retainers (screw hole plugs) 215. The air space retainers are attached to the body 205 on the opposite side of the grips 210, and protrude away from the body 205. The air space retainers 215 fit into screw holes on a hollow metal frame and protrude into the frame to a distance that a screw typically protrudes when the screw is screwed into the frame. Therefore, when grout is poured into the hollow metal frame, the grout pours around the air space retainers 215. When the grout hardens and the grout guard is removed, an air space is maintained at the location where the air space retainers 215 were located. The base 220 of the air space retainers 215 curves near the surface of the body 205. FIG. 2B illustrates a side view of the body 205 and the air space retainer 215 showing the curved base 220. The curved base 220 provides a sturdy base for the air space retainer 215. It has been determined that when grout hardens around the air space retainers 215, the retainers 215 tend to break close to the body 205, when the grout guard 200 is removed from the frame and hardened grout. Although the curved base 220 prevents the air space retainers 215 from breaking, the grout guard 200 is typically a single use apparatus due to the possible destruction of the air space retainers 215 from multiple uses.

The grout guard 200 also includes a dead bolt hole air space retainer (dead bolt plug) 230. The hinges for hollow metal door frames typically include a dead bolt hole that receive a dead bolt that is typically installed in metal doors. Therefore, the dead bolt hole air space retainer 230 maintains the air space needed in the hollow frame to receive a dead bolt after the 0grout hardens. The dead bolt hole air space retainer 230 has a curved base 240 similar to the air space retainers 215.

Referring still to FIGS. 2A and 2B, the grout guard 200 also includes a ring gasket 225, 235 on each of the air space retainers 215, 230 respectively. The ring gaskets 225, 235 are located around the circumference of the air space retainers 215, 230 at a distance away from the body 205. The distance away from the body 205 is typically a distance that corresponds to openings on the a door frame (not shown). The ring gaskets provide a barrier from which grout can leak from the holes on the hollow metal frame. The ring gaskets 225, 235 are typically rubber or other durable but flexible material. The ring gaskets 225, 235 typically tear away from the air space retainers 215, 230 when the grout guard 200 is removed from the frame and hardened grout. The ring gaskets 225, 235 can either be removed or fall away from the frame. If the gaskets 225, 235 stay affixed to the grout, a screw can easily be inserted without interference from any remnants of the ring gaskets 225, 235. The easy destructibility of the gaskets 225, 235 is one reason the grout guard 200 is typically a single use apparatus.

FIG. 3 illustrates a grout guard 300 having a gasket 325. The gasket 325 includes several holes, such as dead bolt hole air space retainer hole 320, that fit the air space retainers 310,315. The gasket 325 typically fits flush against the surface of the grout guard planar body 305. An adhesive can be added between the gasket 325 and the body 305 to provide a secure mechanical connection between the gasket 325 and the surface of the body 305. The gasket 325 is typically a flexible material, such as neoprene. It is understood that other flexible and porous materials can be used for the gasket 325. The gasket 325 is used to provide a deformable cushion between the body 305 of the grout guard 300 and a metal frame. This flexibility and deformability is necessary because of possible surface irregularities of the metal frame. The gasket therefore receives and cushions irregularities in the frame so that the body 305 of the grout guard 300 remains substantially straight or parallel with respect to the frame. A further description of the gasket 325 is discussed below with respect to the grout guard 300 operation.

Figure 4:
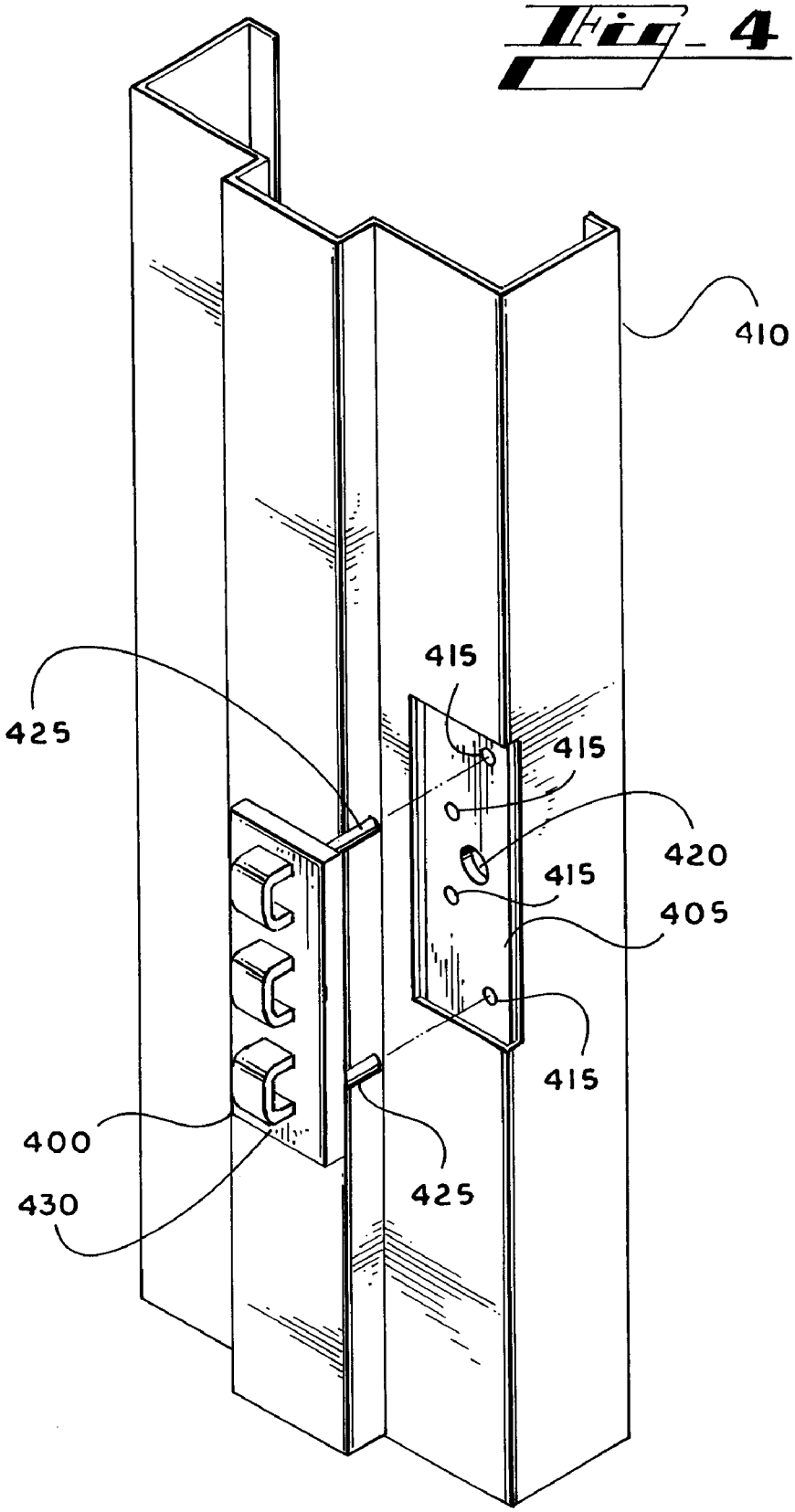
FIG. 4 illustrates a perspective view of a grout guard as it is inserted into a hinge mortise on a hollow metal frame.

FIG. 4 illustrates a perspective view of a grout guard 400 as it is inserted into a hinge mortise 405 on a hollow metal frame 410. There are typically a number of hinge mortises such as mortise 405 on the door frame 410. Each mortise 405 has a number of holes 415 into which screws are secured once a hinge (not shown) is placed on the mortise 405. Each mortise 405 typically also includes a hole 420 into which a dead bolt (not shown) can be affixed. As described above, before hinges are affixed to the door frame 410 grout is typically added to the hollow frame 410. Therefore, in order to reserve the air spaces for easy insertion of screws, the air space retainers 425 of the grout guard 400 are inserted into the holes 415,420. Also, as indicated above, the body 430 of the grout guard is typically a rectangular shape so that it fits snugly into the mortise 405.

Figure 5B:
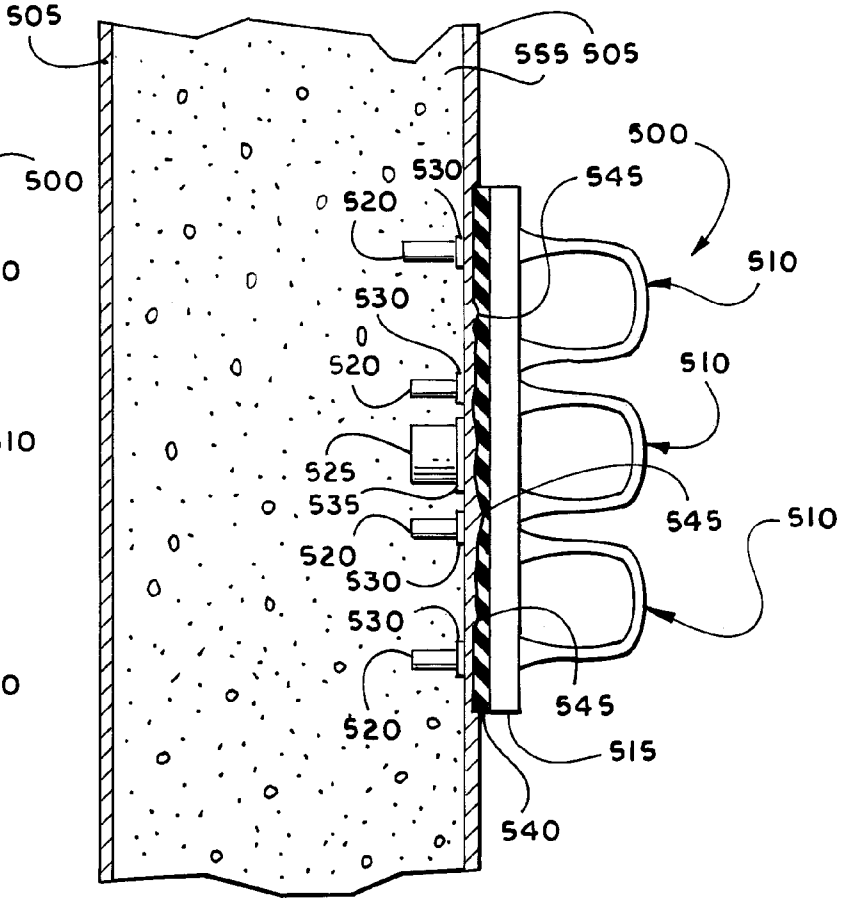
FIG. 5B illustrates a side view of an embodiment of a grout guard inserted into a hollow metal frame filled with grout.
Figure 5A:
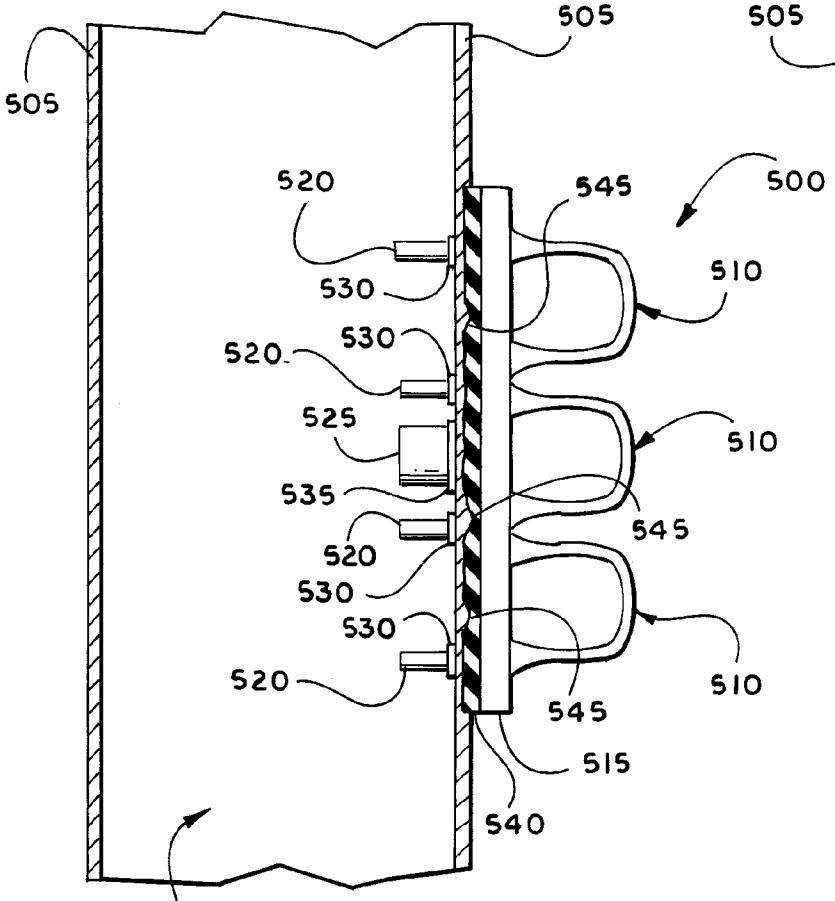
FIG. 5A illustrates a side view of an embodiment of a grout guard inserted into a hollow metal frame.

FIG. 5A illustrates a side view of an embodiment of a grout guard 500 inserted into a metal frame 505 having a hollow interior 550. The figure shows the grout guard 500 having grips 510, a body 545 and air space retainers 520, 525, and a gasket 540. Each of the air space retainers 520, 525 respectively include ring gaskets 530, 535 at an approximate location interior the frame 505, thereby providing a barrier preventing grout from leaking out of the frame 505. The figure also illustrates a series of surface irregularities 545 along the surface of the frame 505. The gasket 540 deforms accordingly at the locations of the irregularities 545 thereby maintaining a substantially uniform penetration of the air space retainers 520, 525 into the interior of the frame 505. The irregularities 545 shown are exaggerated to show the operation of the gasket 540.

FIG. 5B illustrates a side view of an embodiment of a grout guard 500 inserted into a hollow metal frame 505 filled with grout 555. The elements of the grout guard 500 are the same as described with respect to FIG. 5A. FIG. 5B can represent a side view of the frame 505 just as the grout 555 as it is freshly poured into the frame or at a time when the grout has hardened.

Figures 5C, 7:
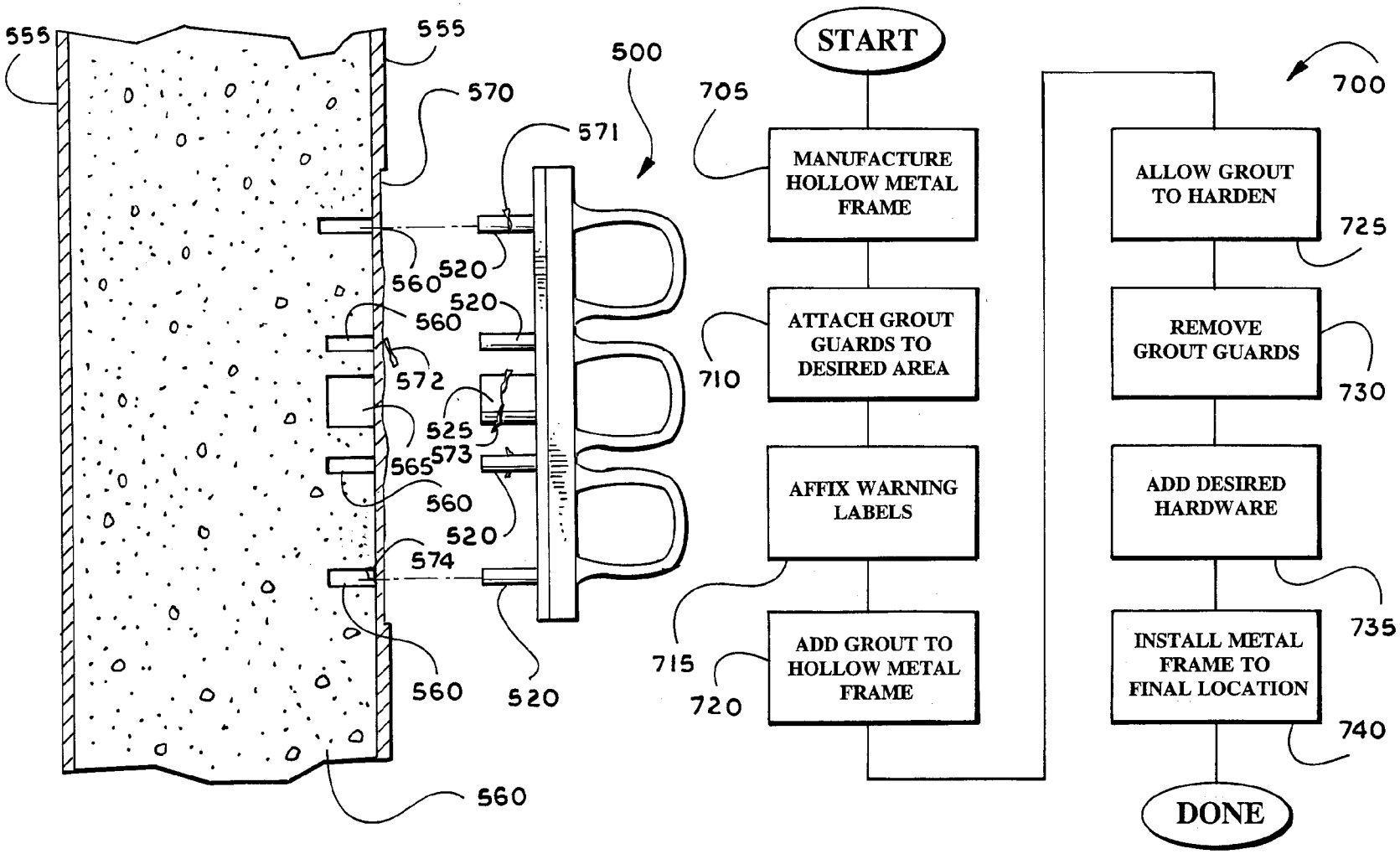
FIG. 5C illustrates a side view of a hollow metal frame filled with grout after an embodiment of a grout guard has been removed.
FIG. 7 illustrates a flow chart of an implementation of a hollow metal manufacturing process.

FIG. 5C illustrates a side view of a hollow metal frame 505 filled with grout 555 after an embodiment of a grout guard 500 has been removed from the frame 505. As discussed above, the grout 555 is hardened prior to removal of the grout guard 500. With the grout guard 500 removed, the mortise area 570 is shown. When the grout guard 500 is removed air spaces 560 have been retained because the air space retainers 520 diverted grout around the retainers 520. Similarly an air space 565 has been retained by the retainer 525. The gaskets 530, 535 (FIGS. 5A–5B) kept grout from pouring out of the screw holes and dead bolt hole. FIG. 5C illustrates the gaskets 530, 535 of FIGS. 5A–5B in a destroyed state. For example, a piece 571 of a gasket is shown still attached to an air space retainer 520. Another piece 572 of a gasket is shown hanging out of an air space 560. Another piece 573 of a gasket is shown on the air space retainer 525. Another piece 574 of a gasket is shown stuck in an air space 560. These examples of the broken gaskets are to illustrate the fact that the gaskets typically are destroyed when the grout guard 500 is removed from the grout 555 and frame 505. In some instances, the gaskets may be in a condition similar to a condition when the grout guard 500 was first installed in the frame 505.

Figure 6:
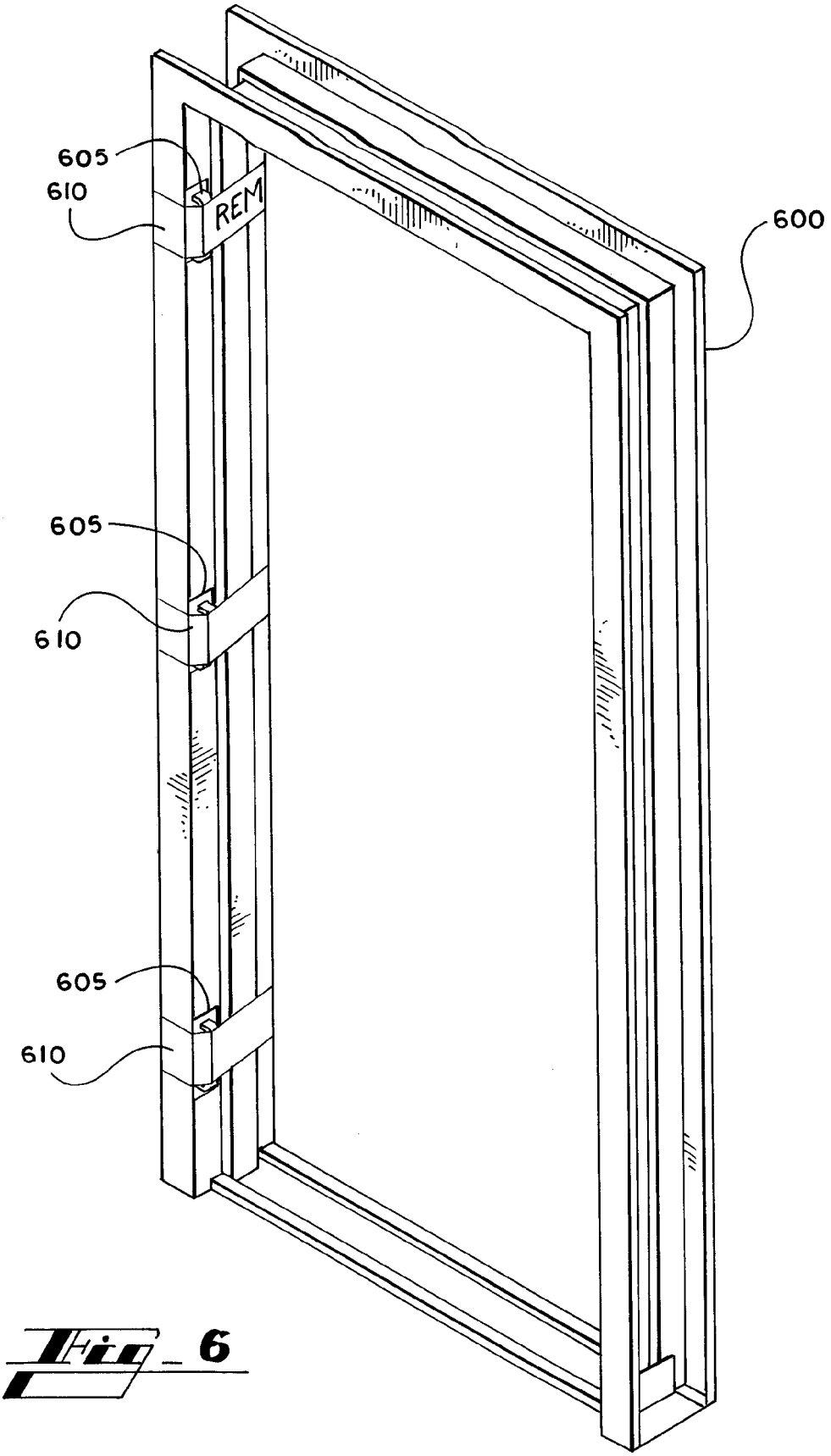
FIG. 6 illustrates a hollow metal door frame having a number of embodiments of a grout guard.

FIG. 6 illustrates a hollow metal door frame 600 having a number of embodiments of a grout guard 605. Each grout guard 605 is shown in place on the door frame in a respective mortise. The door frame 600 is standing alone and has not been placed in a wall. Door frames such as door frame 600 are typically shipped in this form. Grout can then be added when the frame 600 is delivered to its final destination. Since the grout guards 605 are not to be removed until the grout has been added and hardened, the guards 605 can be taped or otherwise attached to the frame 600 by tape/ribbon 610. The tape/ribbon 610 can include warning text such as "DO NOT REMOVE UNTIL GROUT HAS HARDENED". In this way, the final installers can be reminded not to remove the grout guards 605 until the grout has hardened and air spaces retained for hinge and other hardware attachments.

FIG. 7 illustrates a flow chart of an implementation of a hollow metal manufacturing process 700. A hollow frame or any other hollow metal apparatus is manufactured 705. The grout guards are attached 710 to the desired areas of the hollow metal frame. AS discussed above, these areas where the grout guards are attached are typically areas in which hardware such as hinges, strikes plates or other hardware are to be added and where it is necessary to retain air spaces in the hardened grout. Warning labels are affixed 715 over the grout guards to warn the installers that the grout guards are to remain in place while the grout hardens. The frames are typically shipped to their final destinations where the grout is then added 720 to the frame. The grout is allowed 725 to harden. Once the grout is hardened, the grout guards are removed 730 and the desired hardware is added 735. The frame is then installed 740. In another implementation, the frame can be installed, and then the grout added. There are several orders that can be followed for installation. The methods described above are not limited to any one order. FIG. 7 is illustrative of one order.

A number of embodiments have been described. Nevertheless, is will be understood that various modifications may be made without departing from the spirit and scope of the invention. Several examples are now illustrated.

Figure 8A:
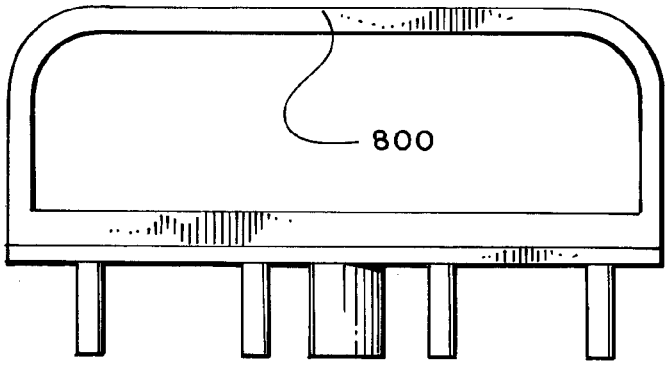
FIGS. 8A–8D illustrate several alternative embodiments of grips for an embodiment of a grout guard.

FIGS. 8A–8D illustrate several alternative embodiments of grips for an embodiment of a grout guard. FIG. 8A illustrates an embodiment of a grout guard having a single large grip 800 that can typically be handled by the user's entire hand.

Figure 8B:
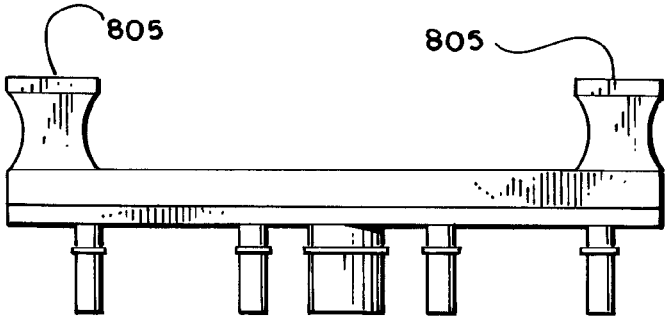

FIG. 8B illustrates an embodiment of a grout guard having two side handles 805 that can individually handled by the user's hands.

Figure 8C:
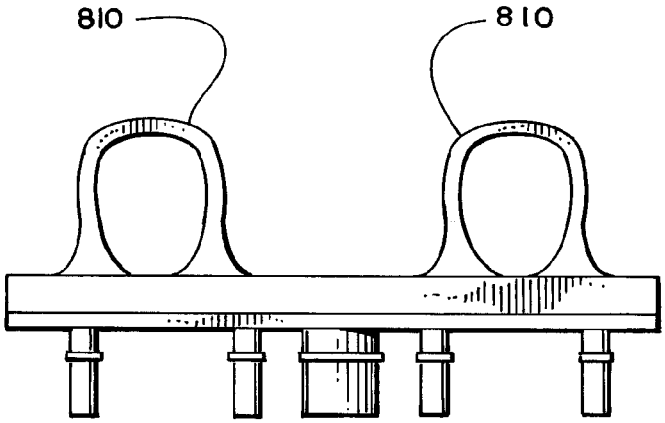

FIG. 8C illustrates an embodiment of a grout guard having two finger loops 810, in contrast to the three loops that are described in the embodiments above.

Figure 8D:
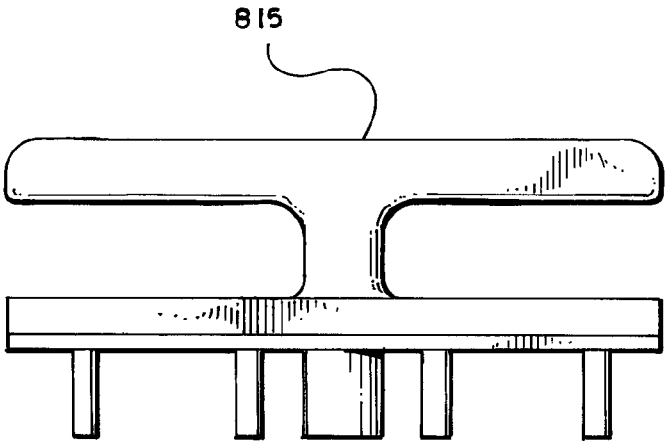

FIG. 8D illustrates an embodiment of a grout guard having a single handle 815 that can be gripped by a user's hand.

The embodiments and methods described above have illustrated that grout is typically added to hollow frames. It is understood that the embodiments and methods described above can be used with other filling materials in hollow frames such as cement or other suitable material.

Therefore, the foregoing is considered as illustrative only of the principles of the invention. Further, various modifications may be made of the invention without departing from the scope thereof and it is desired, therefore, that only such limitations shall be placed thereon as are imposed by the prior art and which are set forth in the appended claims.

What is claimed is:

1. An apparatus, comprising:

a substantially planar body having an upper surface and a lower surface;

at least one hand grip connected to the upper surface, the hand grip being optionally adapted to be engaged by a tool;

a plurality of air space retainers connected to and substantially perpendicular to the lower surface; and a substantially planar gasket having a first and a second surface, wherein the first surface is in contact with the lower surface of the planar body, and wherein the air space retainers protrude from the second surface of the gasket.

2. An apparatus, comprising:

a substantially planar body having an upper surface and a lower surface;

at least one hand grip connected to the upper surface, the hand grip being optionally adapted to be engaged by a tool;

a plurality of air space retainers connected to and substantially perpendicular to the lower surface, wherein each of the air space retainers is a substantially cylindrical rod having a first radius, and wherein each cylindrical rod includes a gasket ring wrapped along the circumference of the rods, each ring having an outer radius larger than the first radius, wherein the ring is located at a point along the rod at a length measured from the lower surface of the body.

3. The apparatus as claimed in claim 2 wherein the cylindrical rod has a third radius located at a point along the rod where the rod intersects the body, wherein the third radius is greater than the first radius.

4. A grout guard for retaining grout within a hollow metal structure having hardware holes, the grout guard comprising:

a substantially planar body having an upper surface and a lower surface;

at least one hand grip connected to the upper surface;

a gasket connected to the lower surface, the gasket being adapted to conform to imperfections on a surface on the hollow metal structure onto which the gasket comes into contact;

a plurality of cylindrical protrusions connected to and substantially perpendicular to the lower surface and to the gasket, the protrusions each having a circular ring gasket around the circumference of the protrusions, wherein the protrusions are adapted to fit within the hardware holes and wherein the circular ring gaskets are adapted to form a seal in the hardware holes.

5. A grout guard kit, comprising:

a hollow metal frame having a plurality of hardware holes;

a grout guard adapted to be attached and removed from the hollow metal frame, the grout guard having a plurality of protrusions adapted to engage the hardware holes; and grout adapted to be added to the interior of the hollow metal frame, the grout being contained within the frame by ring gaskets connected to the circumference of each of the plurality of protrusions.

6. The kit as claimed in claim 5 wherein the grout guard comprises:

a substantially planar body having an upper surface and a lower surface;

at least one grip connected to the upper surface;

a gasket connected to the lower surface; and a plurality of cylindrical protrusions connected to and substantially perpendicular to the lower surface and to the gasket.

7. A method of manufacturing, comprising:

forming a hollow metal frame;

connecting one or more grout guards to one or more areas of the frame where components are to be added, the grout guards each comprising a substantially planar body having an upper surface and a lower surface, at least one hand grip connected to the planar body, a gasket connected to the planar body, the gasket being adapted to conform to a surface of the metal frame, and a plurality of air space retainers connected to and substantially perpendicular to the lower surface and to the gasket, each of the air space retainers having a ring gasket around the circumference of the air space retainers, the ring gaskets being adapted to prevent grout from flowing out of the frame;

adding grout to the interior of the frame; and removing the grout guards after the grout hardens, wherein the ring gaskets are optionally left behind in the hardware holes and air spaces formed in the hardened grout by the air space retainers.

8. The method as claimed in claim 7, wherein the grout guards is used only once and disposed.

9. A method of installing a hollow metal frame, comprising:

placing a hollow metal frame;

attaching one or more grout guards to areas of the frame where components are to be added, the grout guards each comprising a substantially planar body having an upper surface and a lower surface, at least one hand grip connected to the planar body, a gasket connected to the planar body, the gasket being adapted to conform to a surface of the metal frame, and a plurality of air space retainers connected to and substantially perpendicular to the lower surface and to the gasket, each of the air space retainers having a ring gasket around the circumference of the air space retainers, the ring gaskets being adapted to prevent grout from flowing out of the frame;

adding grout to the interior of the frame, wherein the grout is retained within the frame by the ring gaskets;

removing the grout guard when the grout hardens; and adding the components to the frame.

10. An apparatus for retaining grout within a hollow metal structure having several hardware holes, the apparatus comprising:

a substantially planar body having an upper surface and a lower surface;

at least one hand grip connected to the upper surface;

a plurality of air space retainers connected to and substantially perpendicular to the lower surface, the air space retainers being adapted to be inserted into the hardware holes on the hollow metal structure; and a substantially planar gasket having a first and second surface, wherein the first surface is in contact with the lower surface of the planar body, and wherein the air space retainers protrude from the second surface of the gasket, the gasket being adapted to conform to imperfections on a surface of the hollow metal structure so that the planar body remains generally parallel to the surface of the hollow metal structure.

11. An apparatus for retaining grout within a hollow metal structure having several hardware holes, the apparatus comprising:

a substantially planar body having an upper surface and a lower surface;

at least one hand grip connected to the upper surface;

a plurality of air space retainers connected to and substantially perpendicular to the lower surface, the air space retainers being adapted to be inserted into the hardware holes on the hollow metal structure; and a gasket ring wrapped along the circumference of each of the air space retainers, each gasket ring adapted to retain the grout within the hollow metal structure so that grout does not come into contact with the planar body, the ring gaskets being further adapted to break free of the air space retainers.

12. A grout guard kit, comprising:

a hollow metal structure having hardware holes adapted to receive hardware;

a grout guard adapted to be attached and removed from the hollow metal structure, the grout guard comprising a substantially planar body having an upper surface and a lower surface, at least one hand grip connected to the upper surface, a gasket connected to the lower surface, the gasket being adapted to conform to imperfections on a surface of the hollow metal structure, a plurality of cylindrical protrusions connected to and substantially perpendicular to the lower surface and the gasket, the protrusions each having a circular ring gasket around the circumference of the protrusions and being adapted to be inserted into the hardware holes on the hollow metal structure, wherein the protrusions are adapted to be inserted into the hardware holes; and grout adapted to be added to the hollow interior of the hollow metal structure, wherein the circular ring gaskets are adapted to prevent the grout from flowing out of the hardware holes.

13. An apparatus, comprising:

a substantially planar body having an upper surface and a lower surface, the body being adapted to fit within a hinge mortise on a hollow metal frame, the hinge mortise including screw holes and a dead bolt hole;

at least one hand grip connected to the upper surface, the hand grip being adapted to receive forces for applying the apparatus to the hinge mortise;

a gasket connected to the lower surface;

a plurality of screw hole plugs connected to and spaced along the lower surface of the planar body, the plugs being adapted to be inserted into the screw holes; and a dead bolt plug connected to the lower surface of the planar body, the plug being adapted to insert into the dead bolt hole, wherein the screw hole plugs and the dead bolt plug include a ring gasket connected to the circumference of each of the screw and dead bolt plugs.

* * * * *